US009401242B2

(12) United States Patent
Kido et al.

(10) Patent No.: US 9,401,242 B2
(45) Date of Patent: Jul. 26, 2016

(54) COMPOSITE ELECTRONIC COMPONENT AND COMPOSITE ELECTRONIC COMPONENT MANUFACTURING METHOD

(71) Applicant: MURATA MANUFACTURING CO., LTD., Kyoto-fu (JP)

(72) Inventors: Tomohiro Kido, Kyoto-fu (JP); Miho Kitamura, Kyoto-fu (JP); Kazutaka Watanabe, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 47 days.

(21) Appl. No.: 14/491,741

(22) Filed: Sep. 19, 2014

(65) Prior Publication Data

US 2015/0097648 A1 Apr. 9, 2015

(30) Foreign Application Priority Data

Oct. 9, 2013 (JP) ..... 2013-212030

(51) Int. Cl.

| | |
|---|---|
| ***H01F 5/00*** | (2006.01) |
| ***H01F 27/28*** | (2006.01) |
| ***H01F 27/24*** | (2006.01) |
| ***H01F 17/00*** | (2006.01) |
| ***H01F 41/04*** | (2006.01) |

(52) U.S. Cl.

CPC ..... *H01F 27/2885* (2013.01); *H01F 17/0013* (2013.01); *H01F 41/046* (2013.01); *H01F 2017/0093* (2013.01); *Y10T 29/4902* (2015.01)

(58) Field of Classification Search

CPC ..... H01F 27/34

USPC ..... 336/200

See application file for complete search history.

(56) References Cited

U.S. PATENT DOCUMENTS

| | | | | |
|---|---|---|---|---|
| 7,947,428 | B2 * | 5/2011 | Kamijima | G03F 7/0387 333/185 |
| 2003/0076211 | A1 | 4/2003 | Matsuta et al. | |
| 2011/0007439 | A1 | 1/2011 | Asakawa et al. | |
| 2012/0306609 | A1 | 12/2012 | Kato | |
| 2014/0139307 | A1 | 5/2014 | Kido et al. | |
| 2014/0176286 | A1 | 6/2014 | Okada et al. | |

FOREIGN PATENT DOCUMENTS

| | | | |
|---|---|---|---|
| JP | 2003133135 | A | 5/2003 |
| JP | 2007214166 | A | 8/2007 |
| JP | 2010-028695 | A | 2/2010 |

(Continued)

OTHER PUBLICATIONS

English translation of JP2005159123.*

(Continued)

*Primary Examiner* — Elvin G Enad
*Assistant Examiner* — Ronald Hinson
(74) *Attorney, Agent, or Firm* — Studebaker & Brackett PC

(57) ABSTRACT

A composite electronic component includes a multilayer body, coils, an antistatic element and outer electrodes. The multilayer body is configured by laminating insulator layers. The coils are provided on the upper surfaces of the insulator layers. The antistatic element is connected to the coils and includes ground electrodes. The outer electrodes are connected to the coils. The upper surfaces of the insulator layers on which the coils are provided do not intersect with the ground electrodes.

8 Claims, 13 Drawing Sheets

(56) References Cited

FOREIGN PATENT DOCUMENTS

| | | | |
|---|---|---|---|
| JP | 2010027999 | A | 2/2010 |
| JP | 2010087030 | A | 4/2010 |
| JP | 2010098024 | A | 4/2010 |
| JP | 2010141642 | A | 6/2010 |
| JP | 2011-018756 | A | 1/2011 |
| JP | 2013012702 | A | 1/2013 |
| JP | 2013098258 | A | 5/2013 |
| JP | WO2013031842 | A1 | 3/2015 |
| JP | WO2013031880 | A1 | 3/2015 |

OTHER PUBLICATIONS

English translation of JP2006041081.*

An Office Action issued by the Japanese Patent Office on Oct. 6, 2015, which corresponds to Japanese Patent Application No. 2013-212030 and is related to U.S. Appl. No. 14/491,741; with English language summary.

* cited by examiner

COMPOSITE ELECTRONIC COMPONENT AND COMPOSITE ELECTRONIC COMPONENT MANUFACTURING METHOD

CROSS REFERENCE TO RELATED APPLICATIONS

This application claims benefit of priority to Japanese Patent Application No. 2013-212030 filed Oct. 9, 2013, the entire content of which is incorporated herein by reference.

TECHNICAL FIELD

The present technical field relates to a composite electronic component and a composite electronic component manufacturing method. To be specific, the disclosure relates to a composite electronic component including an antistatic element and a coil and a method of manufacturing the same.

BACKGROUND

Hitherto, a noise filter component as described in Japanese Unexamined Patent Application Publication No. 2010-28695 has been known as an existing composite electronic component. The composite electronic component of this type includes a multilayer body formed by a plurality of insulator layers, a coil provided on the insulator layer, and an antistatic element connected to the coil. The antistatic element includes a ground electrode.

In the above-mentioned composite electronic component, the ground electrode included in the antistatic element is provided across the side surface of the multilayer body from the bottom surface to the upper surface, so that the ground electrode provided on a side surface portion and an outer circumferential portion of the coil are close to each other. This raises a problem that stray capacitance is generated between the ground electrode and the coil.

SUMMARY

Accordingly, it is an object of the present disclosure to provide a composite electronic component including an antistatic element and a coil, which can suppress stray capacitance to be generated between a ground electrode included in the antistatic element and the coil, and a method of manufacturing the same.

According to a first preferred embodiment of the present disclosure, there is provided a composite electronic component including a multilayer body formed by laminating a plurality of insulator layers, a first coil provided on the insulator layer, an antistatic element connected to the first coil and including a ground electrode, and an outer electrode connected to the first coil. In the composite electronic component, the ground electrode does not intersect with a surface of the insulator layer on which the first coil is provided.

According to a second preferred embodiment of the present disclosure, there is provided a composite electronic component manufacturing method that is a method of manufacturing the above-mentioned composite electronic component, the method including forming the outer electrode and a conductor included in the antistatic element at the same time.

In the composite electronic component, the surface of the insulator layer on which the first coil is provided does not intersect with the ground electrode. This can prevent the first coil and the ground electrode from being close to each other, thereby suppressing generation of stray capacitance.

According to the present disclosure, in the composite electronic component including the antistatic element and the coil, stray capacitance that is generated between the ground electrode included in the antistatic element and the coil can be suppressed.

Other features, elements, characteristics and advantages of the present disclosure will become more apparent from the following detailed description of preferred embodiments of the present disclosure with reference to the attached drawings.

DETAILED DESCRIPTION

Figure 1:
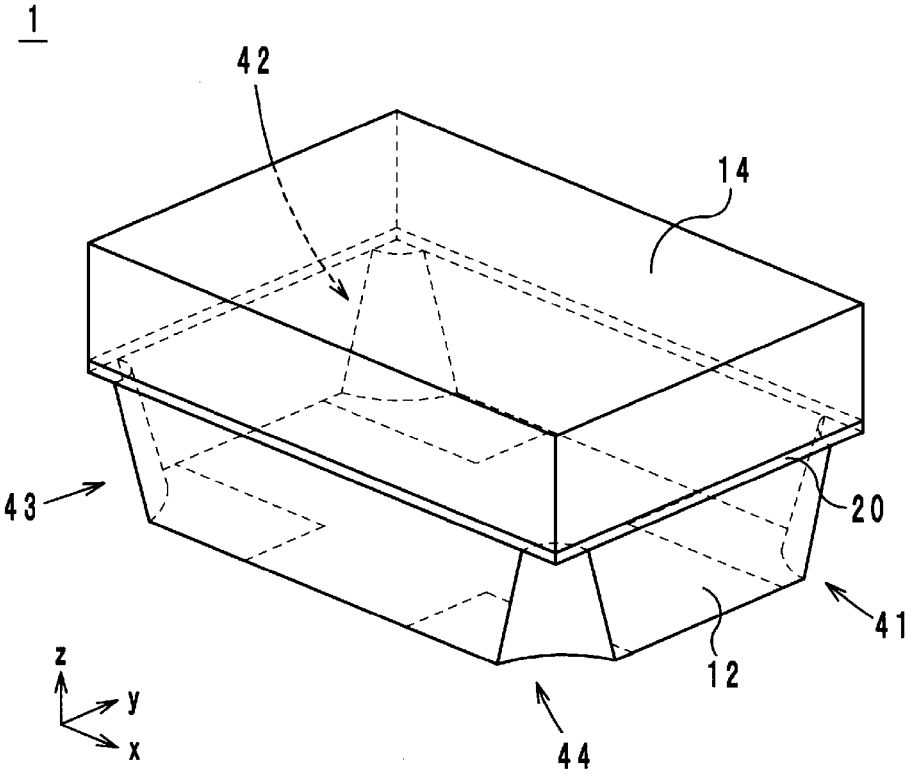
FIG. 1 is an outer appearance view illustrating a composite electronic component according to an embodiment of the disclosure.
Figure 2:
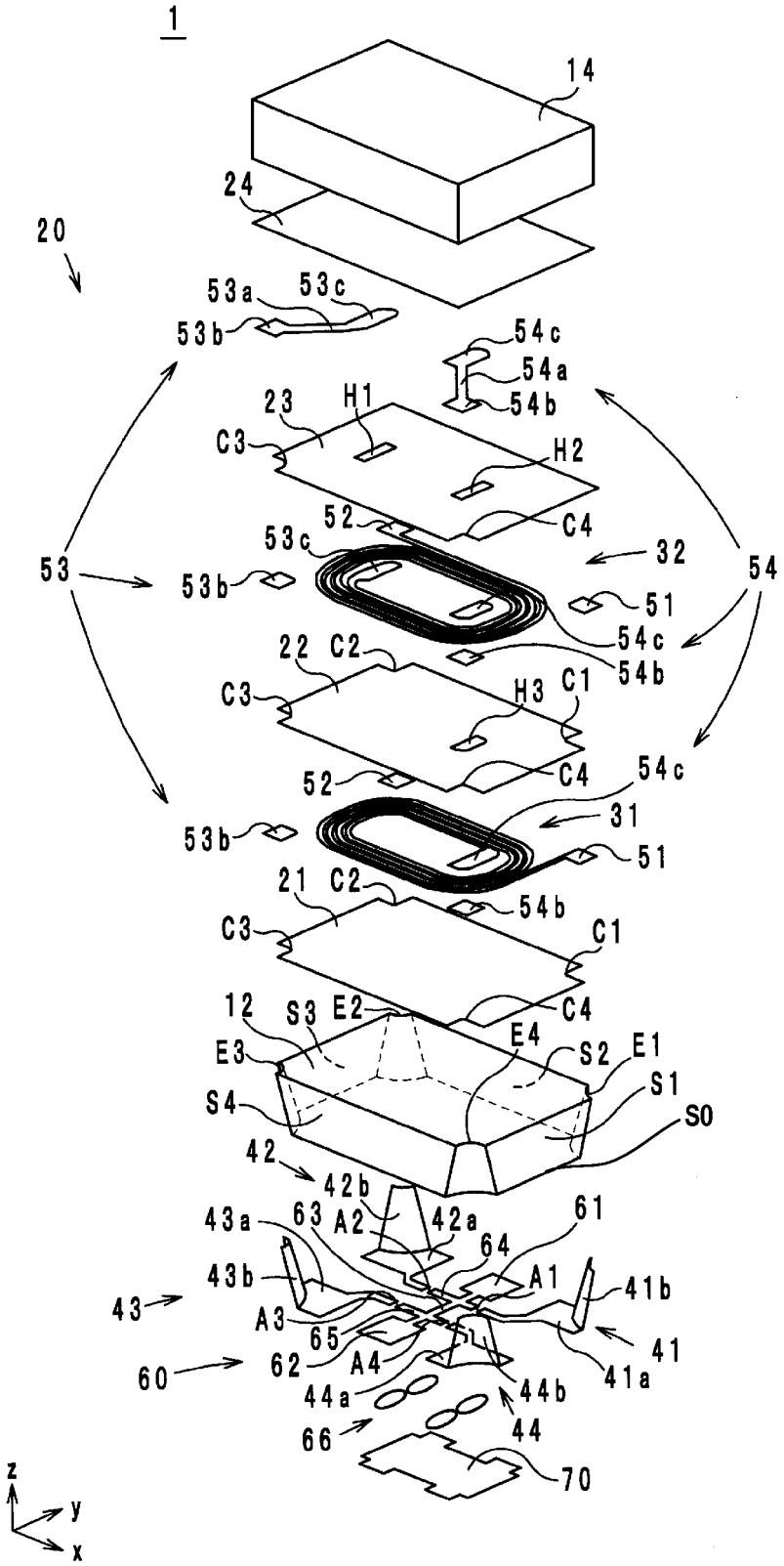
FIG. 2 is an exploded perspective view illustrating the composite electronic component according to the embodiment.

Schematic Configuration of Composite Electronic Component (see FIG. 1 and FIG. 2)

The following describes a composite electronic component 1 according to an embodiment with reference to the drawings. Hereinafter, a lamination direction of the electronic component 1 is defined as a z-axis direction. Further, when seen from above in the z-axis direction, the direction along a long side of the electronic component 1 is defined as an x-axis direction and the direction along a short side thereof is defined as a y-axis direction. A surface located at the positive side in the z-axis direction is referred to as an upper surface and a surface located at the negative side in the z-axis direction is referred to as a lower surface. It should be noted that the x-axis, the y-axis, and the z-axis are orthogonal to one another.

As illustrated in FIG. 1, the composite electronic component 1 is a substantially rectangular parallelepiped. As illustrated in FIG. 2, the composite electronic component 1 includes a magnetic substrate 12, a magnetic layer 14, a multilayer body 20, coils 31 and 32, outer electrodes 41 to 44, connection conductors 51 to 54, an antistatic element 60, and an antistatic element protection layer 70.

Configurations of Magnetic Substrate and Magnetic Layer (see FIG. 2)

The magnetic substrate 12 is located at the negative side in the z-axis direction of the composite electronic component 1. A lower surface S0 (electrode formation surface) of the magnetic substrate 12 corresponds to a mounting surface when the composite electronic component 1 is mounted on a circuit substrate. The magnetic substrate 12 is produced by cutting out sintered ferrite ceramics. The magnetic substrate may be produced by applying pastes including ferrite calcined powder and a binder onto a ceramics substrate made of alumina or the like or may be produced by laminating and sintering green sheets made of a ferrite material. Alternatively, the magnetic substrate 12 may be produced by thermally curing an epoxy resin containing metal magnetic powder, or the like.

The magnetic substrate 12 is a substantially rectangular parallelepiped. Four corners of the magnetic substrate 12 at the lower surface side have cutouts. To be specific, a corner E1 formed by a side surface S1 of the magnetic substrate 12 located at the positive side in the x-axis direction and a side surface S2 thereof located at the positive side in the y-axis direction, a corner E2 formed by the side surface S2 and a side surface S3 located at the negative side in the x-axis direction, a corner E3 formed by the side surface S3 and a side surface S4 located at the negative side in the y-axis direction, and a corner E4 formed by the side surface S1 and the side surface S4 have the cutouts.

The magnetic layer 14 is a member having a shape of substantially rectangular parallelepiped, which is located on an end portion of the composite electronic component 1 at the positive side in the z-axis direction thereof. A material of the magnetic layer 14 is a resin containing magnetic powder or magnetic ceramics. Examples of the magnetic powder include ferrite and a metal magnetic material and examples of the resin include a polyimide resin and an epoxy resin. The thickness of the magnetic layer 14 is smaller than the thickness of the magnetic substrate 12 and the initial magnetic permeability of the magnetic layer 14 is lower than the initial magnetic permeability of the magnetic substrate 12.

Configuration of Multilayer Body (see FIG. 2)

The multilayer body 20 is a member having a shape of substantially rectangular parallelepiped, which is formed by laminating insulator layers 21 to 24 made of polyimide. The multilayer body 20 is interposed between the magnetic substrate 12 and the magnetic layer 14. The insulator layers 21 to 24 may be made of an insulating resin such as benzocyclobutene or made of an insulating inorganic material such as glass ceramics.

The insulator layers 21 to 24 have substantially rectangular shapes when seen from the above in the z-axis direction and are laminated in this order from the negative side to the positive side in the z-axis direction. Corners C1 of the insulator layers 21 and 22, which are formed by the outer edges at the positive side in the x-axis direction and the outer edges at the positive side in the y-axis direction, and corners C2 thereof, which are formed by the outer edges at the negative side in the x-axis direction and the outer edges at the positive side in the y-axis direction, have cutouts. Further, corners C3 of the insulator layers 21 to 23, which are formed by the outer edges at the negative side in the x-axis direction and the outer edges at the negative side in the y-axis direction, and corners C4 thereof, which are formed by the outer edges at the positive side in the x-axis direction and the outer edges at the negative side in the y-axis direction, also have cutouts.

Two through-holes H1 and H2 passing through the insulator layer 23 in the z-axis direction are provided on the insulator layer 23 at the center in the y-axis direction. The through-holes H1 and H2 have substantially rectangular shapes when seen from the z-axis direction and are aligned in this order from the negative side to the positive side in the x-axis direction.

A through-hole H3 passing through the insulator layer 22 in the z-axis direction is provided on the insulator layer 22 at the center in the y-axis direction. The through-hole H3 is a substantially rectangular hole provided so as to overlap with the through-hole H2 when seen from the above in the z-axis direction.

Configuration of Coils (see FIG. 2)

The coils 31 and 32 are wire conductors made of a conductive material such as Au, Ag, Cu, Pd, Ni, and the like, which are provided inside the multilayer body 20. The coil 31 and the coil 32 are electromagnetically coupled to each other so as to configure a common mode choke coil.

As illustrated in FIG. 2, the coil 31 is provided on the upper surface of the insulator layer 21 and forms a substantially spiral form in which it gets closer to the center as wound in the clockwise direction when seen from the positive side in the z-axis direction. An end portion of the coil 31 at the outer circumferential side extends toward the corners C1. Further, an end portion of the coil 31 at the inner circumferential side is located so as to overlap with the through-holes H2 and H3 when seen from the above in the z-axis direction.

The coil 32 is provided on the upper surface of the insulator layer 22 and forms a substantially spiral form in which it gets closer to the center as wound in the clockwise direction when seen from the positive side in the z-axis direction. An end portion of the coil 32 at the outer circumferential side extends toward the corners C2. Further, an end portion of the coil 32 at the inner circumferential side is located so as to overlap with the through-hole H1 when seen from the above in the z-axis direction.

Configuration of Outer Electrodes (see FIG. 2)

The outer electrodes 41 to 44 are made of a material such as Au, Ag, Cu, Pd, Ni, and the like and function as input electrodes or output electrodes of the composite electronic component 1. The outer electrodes 41 to 44 are provided on the lower surface S0 and the side surfaces S1 to S4 of the magnetic substrate 12, and are configured by terminal portions 41*a* to 44*a* and connecting portions 41*b* to 44*b*, respectively. The following describes details thereof.

As illustrated in FIG. 2, the outer electrode 41 is configured by the terminal portion 41*a* and the connecting portion 41*b*. The terminal portion 41*a* is provided on the lower surface S0 of the magnetic substrate 12 in the vicinity of the corner E1. The connecting portion 41*b* extends substantially in the z-axis direction along the surface of the cutout provided on the corner E1. Further, an end portion of the connecting portion 41*b* at the negative side in the z-axis direction is connected to the terminal portion 41*a* and an end portion thereof at the positive side in the z-axis direction is connected to the connection conductor 51, which will be described later.

The outer electrode 42 is configured by the terminal portion 42*a* and the connecting portion 42*b*. The terminal portion 42*a* is provided on the lower surface S0 of the magnetic substrate 12 in the vicinity of the corner E2. The connecting portion 42*b* extends substantially in the z-axis direction along the surface of the cutout provided on the corner E2. Further, an end portion of the connecting portion 42*b* at the negative side in the z-axis direction is connected to the terminal portion 42*a* and an end portion thereof at the positive side in the z-axis direction is connected to the connection conductor 52, which will be described later.

The outer electrode 43 is configured by the terminal portion 43*a* and the connecting portion 43*b*. The terminal portion 43*a* is provided on the lower surface S0 of the magnetic substrate 12 in the vicinity of the corner E3. The connecting portion 43*b* extends substantially in the z-axis direction along the surface of the cutout provided on the corner E3. Further, an end portion of the connecting portion 43*b* at the negative side in the z-axis direction is connected to the terminal portion 43*a* and an end portion thereof at the positive side in the z-axis direction is connected to the connection conductor 53, which will be described later.

The outer electrode 44 is configured by the terminal portion 44*a* and the connecting portion 44*b*. The terminal portion 44*a* is provided on the lower surface S0 of the magnetic substrate 12 in the vicinity of the corner E4. The connecting portion 44*b* extends substantially in the z-axis direction along the surface of the cutout provided on the corner E4. Further, an end portion of the connecting portion 44*b* at the negative side in the z-axis direction is connected to the terminal portion 44*a* and an end portion thereof at the positive side in the z-axis direction is connected to the connection conductor 54, which will be described later.

Configuration of Connection Conductors (see FIG. 2)

The connection conductors 51 to 54 are made of a conductive material such as Au, Ag, Cu, Pd, Ni, and the like and function for connecting the outer electrodes 41 to 44 and the coils 31 and 32.

As illustrated in FIG. 2, the connection conductor 51 extends in the z-axis direction so as to fill the cutouts provided on the corners C1 of the insulator layers 21 and 22. Further, a portion of the connection conductor 51, which is located on the insulator layer 21, is connected to the end portion of the coil 31 at the outer circumferential side. An end portion of the connection conductor 51 at the negative side in the z-axis direction is connected to the end portion of the connecting portion 41*b* of the outer electrode 41 at the positive side in the z-axis direction.

The connection conductor 52 extends in the z-axis direction so as to fill the cutouts provided on the corners C2 of the insulator layers 21 and 22. Further, an end portion of the connection conductor 52 at the positive side in the z-axis direction is connected to the end portion of the coil 32 at the outer circumferential side. An end portion of the connection conductor 52 at the negative side in the z-axis direction is connected to the end portion of the connecting portion 42*b* of the outer electrode 42 at the positive side in the z-axis direction.

The connection conductor 53 is configured by an extraction portion 53*a* and via conductor portions 53*b* and 53*c*. The extraction portion 53*a* is a wire conductor provided on the insulator layer 23 and extends from the corner C3 toward the through-hole H1.

The via conductor portion 53*b* extends in the z-axis direction so as to fill the cutouts provided on the corners C3 of the insulator layers 21 to 23. Further, an end portion of the via conductor portion 53*b* at the positive side in the z-axis direction is connected to the extraction portion 53*a*. An end portion of the via conductor portion 53*b* at the negative side in the z-axis direction is connected to the end portion of the connecting portion 43*b* of the outer electrode 43 at the positive side in the z-axis direction.

The via conductor portion 53*c* is provided to fill the through-hole H1 provided on the insulator layer 23. Further, an end portion of the via conductor portion 53*c* at the negative side in the z-axis direction makes contact with the insulator layer 22. With this, an end portion of the via conductor portion 53*c* at the positive side in the z-axis direction is connected to the extraction portion 53*a* and the end portion of the via conductor portion 53*c* at the negative side in the z-axis direction is connected to the end portion of the coil 32 at the inner circumferential side. With this configuration, the connection conductor 53 connects the outer electrode 43 and the coil 32.

The connection conductor 54 is configured by an extraction portion 54*a* and via conductor portions 54*b* and 54*c*. The extraction portion 54*a* is a wire conductor provided on the insulator layer 23 and extends from the corner C4 toward the through-hole H2.

The via conductor portion 54*b* extends in the z-axis direction so as to fill the cutouts provided on the corners C4 of the insulator layers 21 to 23. Further, an end portion of the via conductor portion 54*b* at the positive side in the z-axis direction is connected to the extraction portion 54*a*. An end portion of the via conductor portion 54*b* at the negative side in the z-axis direction is connected to the end portion of the connecting portion 44*b* of the outer electrode 44 at the positive side in the z-axis direction.

The via conductor portion 54*c* is provided to fill the through-holes H2 and H3 provided on the insulator layers 22 and 23. Further, an end portion of the via conductor portion 54*c* at the negative side in the z-axis direction makes contact with the insulator layer 21. With this, an end portion of the via conductor portion 54*c* at the positive side in the z-axis direction is connected to the extraction portion 54*a* and the end portion of the via conductor portion 54*c* at the negative side in the z-axis direction is connected to the end portion of the coil 31 at the inner circumferential side. With this configuration, the connection conductor 54 connects the outer electrode 44 and the coil 31.

Figure 3:
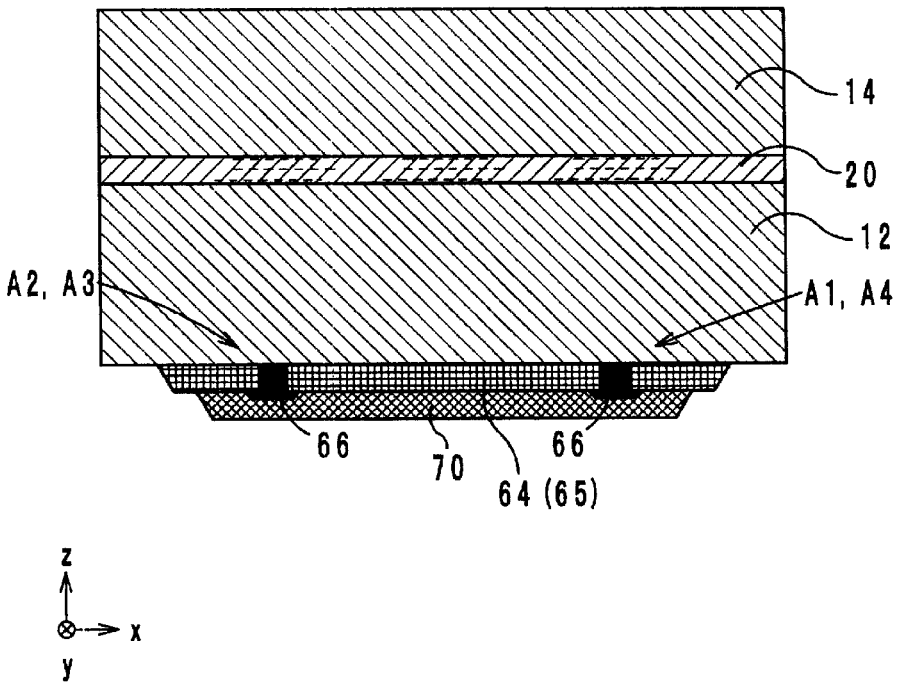
FIG. 3 is a cross-sectional view illustrating the composite electronic component according to the embodiment cut along a cross section passing through a discharge electrode.

Configuration of Antistatic Element (see FIG. 2 and FIG. 3)

As illustrated in FIG. 2, the antistatic element 60 is provided on the lower surface S0 (electrode formation surface) of the magnetic substrate 12. The antistatic element 60 is configured by ground electrodes 61 and 62, a connection electrode 63, discharge electrodes 64 and 65, and static electricity absorbers 66. The following describes details thereof.

The ground electrodes 61 and 62 are substantially rectangular conductor layers made of a conductive material such as Au, Ag, Cu, Pd, Ni, and the like and are provided on the lower surface S0 of the magnetic substrate 12 substantially at the center in the x-axis direction. The ground electrode 61 is provided on the lower surface S0 of the magnetic substrate 12 in the vicinity of the outer edge thereof at the positive side in the y-axis direction. The ground electrode 62 is provided on the lower surface S0 of the magnetic substrate 12 in the vicinity of the outer edge thereof at the negative side in the y-axis direction. The ground electrodes 61 and 62 do not include connecting portions (the connecting portions 41*b* to 44*b* for the outer electrodes to 44, respectively) extending in the z-axis direction unlike the outer electrodes 41 to 44.

The connection electrode 63 is a wire conductor made of a conductive material such as Au, Ag, Cu, Pd, Ni, and the like. The connection electrode 63 is provided on the lower surface S0 of the magnetic substrate 12 substantially at the center in the x-axis direction. The connection electrode 63 connects an end portion of the ground electrode 61 at the negative side in the y-axis direction and an end portion of the ground electrode 62 at the positive side in the y-axis direction.

The discharge electrodes 64 and 65 are wire conductors extending in parallel with the x-axis and are provided so as to be aligned in this order from the positive side in the y-axis direction. The discharge electrodes 64 and 65 and the connection electrode 63 intersect with each other on the lower surface S0 of the magnetic substrate 12 substantially at the center in the x-axis direction.

An end portion of the discharge electrode 64 at the positive side in the x-axis direction is connected to the terminal portion 41*a* of the outer electrode 41. An end portion of the discharge electrode 64 at the negative side in the x-axis direction is connected to the terminal portion 42*a* of the outer electrode 42. Further, the discharge electrode 64 is cut at one place on a portion at the positive side in the x-axis direction and one place on a portion at the negative side in the x-axis direction with respect to the connection electrode 63 as a boundary. That is, the discharge electrode 64 is cut at two places in total. Fine gaps A1 and A2 are formed on the respective cut portions of the discharge electrode 64.

An end portion of the discharge electrode 65 at the negative side in the x-axis direction is connected to the terminal portion 43*a* of the outer electrode 43. An end portion of the discharge electrode 65 at the positive side in the x-axis direction is connected to the terminal portion 44*a* of the outer electrode 44. Further, the discharge electrode 65 is cut at one place on a portion at the positive side in the x-axis direction and one place on a portion at the negative side in the x-axis direction with respect to the connection electrode 63 as a boundary. That is, the discharge electrode 65 is cut at two places in total. Fine gaps A3 and A4 are formed on the respective cut portions of the discharge electrode 65.

The static electricity absorbers 66 are members formed by mixing conductive fine powder into thermosetting rubber, a synthetic resin, or the like. Four static electricity absorbers 66 are provided on the lower surface S0 of the magnetic substrate 12. To be specific, as illustrated in FIG. 3, the static electricity absorbers 66 are interposed in the two fine gaps A1 and A2 of the discharge electrode 64 and the two fine gaps A3 and A4 of the discharge electrode 65. The static electricity absorbers 66 have a property that lowers electric resistance when a voltage of equal to or higher than a constant value is applied and function as a varistor.

Antistatic Element Protection Layer (see FIG. 2)

The antistatic element protection layer 70 is formed by a polyimide resin or an epoxy resin. As illustrated in FIG. 2, the antistatic element protection layer 70 has a shape in which two crosses are aligned in the x-axis direction when seen from the above in the z-axis direction and covers the antistatic element 60.

Functions of Composite Electronic Component

In the composite electronic component 1 configured as described above, the coils 31 and 32 overlap with each other when seen from the above in the z-axis direction. With this, a magnetic flux generated by an electric current flowing through the coil 31 passes through the coil 32 and a magnetic flux generated by an electric current flowing through the coil 32 passes through the coil 31. As a result, the coil 31 and the coil 32 are magnetically coupled to each other so as to configure a common mode choke coil.

In the embodiment, the outer electrodes 41 and 42 are used as the input terminals and the outer electrodes 43 and 44 are used as the output terminals. That is to say, a differential transmission signal is input from the outer electrodes 41 and 42 and is output from the outer electrodes 43 and 44. When the differential transmission signal contains common mode noise, the coils 31 and 32 generate magnetic fluxes substantially in the same direction with a common mode noise current. Therefore, the magnetic fluxes strengthen each other and impedance for the electric current of the common mode noise is generated. As a result, the common mode noise current is transformed to heat, thereby preventing the common mode noise current from passing through the coils 31 and 32.

On the other hand, when a normal mode current flows, the magnetic flux that is generated on the coil 31 and the magnetic flux that is generated on the coil 32 have opposite directions. Therefore, the magnetic fluxes cancel each other, so that no impedance is generated for the normal mode current. Accordingly, the normal mode current can pass through the coils 31 and 32.

Further, when a voltage of equal to or higher than a predetermined value, for example, an excessive voltage due to static electricity is applied to any of the outer electrodes 41 to 44, electricity is discharged from the gaps A1 to A4 of the discharge electrodes 64 and 65 through the static electricity absorbers 66. This causes the electric current with the excessive voltage due to the static electricity to flow into the ground electrodes 61 and 62, so that the electric current does not flow into the coils 31 and 32. As a result, the excessive voltage due to the static electricity or the like is not applied to an integrated circuit (IC) or the like connected to the composite electronic component 1. That is to say, the antistatic element 60 included in the composite electronic component 1 protects the IC or the like connected to the composite electronic component 1 from the excessive voltage due to the static electricity or the like.

Method of Manufacturing Composite Electronic Component (see FIG. 4 to FIG. 13)

Hereinafter, a method of manufacturing the composite electronic component 1 is described. The x-axis, the y-axis, and the z-axis of the composite electronic component 1 that is being manufactured correspond to the x-axis, the y-axis, and the z-axis of the finished composite electronic component 1, respectively. Further, the surface of the composite electronic component 1 that is being manufactured at the positive side in the z-axis direction is referred to as the upper surface and the surface thereof at the negative side in the z-axis direction is referred to as the lower surface.

First, a polyimide resin is applied to the upper surface of a mother substrate 112 to be formed as the magnetic substrate 12 thereafter. Photolithography is performed on the mother substrate 112 to which the polyimide resin has been applied. To be specific, portions of the applied polyimide resin, which correspond to the corners C1 to C4 of the finished composite electronic component 1, are shielded from light by photo masks. The upper surface of the mother substrate 112 is exposed to light in this state, so that the polyimide exposed to the light cures. Thereafter, developing is performed, the uncured polyimide resin is removed, and thermal processing is performed. With this, an insulator layer to be formed as the insulator layer 21 thereafter is formed.

An Ag film is film-formed on the upper surface of the insulator layer to be formed as the insulator layer 21 thereafter by using a sputtering method. Further, a resist is applied onto the Ag film. Thereafter, the resist is formed by the photolithography such that the resist has a shape corresponding to each of parts of the coil 31 and the connection conductors 51 to 54. Subsequently, the Ag film is etched by an etchant using the resist as a mask, and then, the resist is removed. With this, the parts of the coil 31 and the connection conductors 51 to 54 are formed on the upper surface of the insulator layer to be formed as the insulator layer 21 thereafter.

By repeating the above-mentioned processes, the insulator layers to be formed as the insulator layers 21 to 24 thereafter and a mother multilayer body 120 configured by the plurality of coils 31 and 32 and the connection conductors 51 to 54 are formed.

Figure 4:
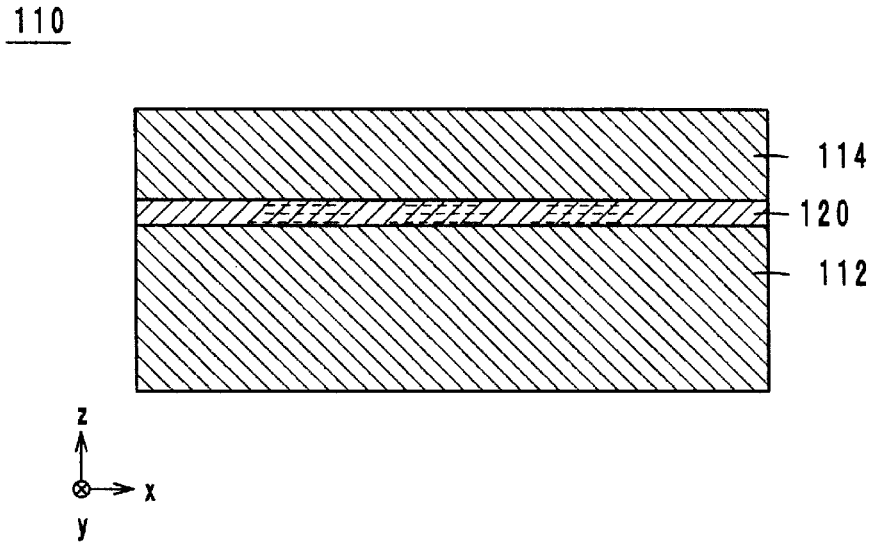
FIG. 4 is a cross-sectional view illustrating the composite electronic component that is being manufactured.

After the multilayer body 120 has been formed, magnetic ceramics is bonded to or a resin containing magnetic powder is thermally pressure-bonded onto the upper surface of the insulator layer to be formed as the insulator layer 24 thereafter. With this, a mother magnetic layer 114 to be formed as the magnetic layer 14 thereafter is formed on the upper surface of the mother multilayer body 120 and a mother main body 110 as illustrated in FIG. 4 is completed.

Figure 5:
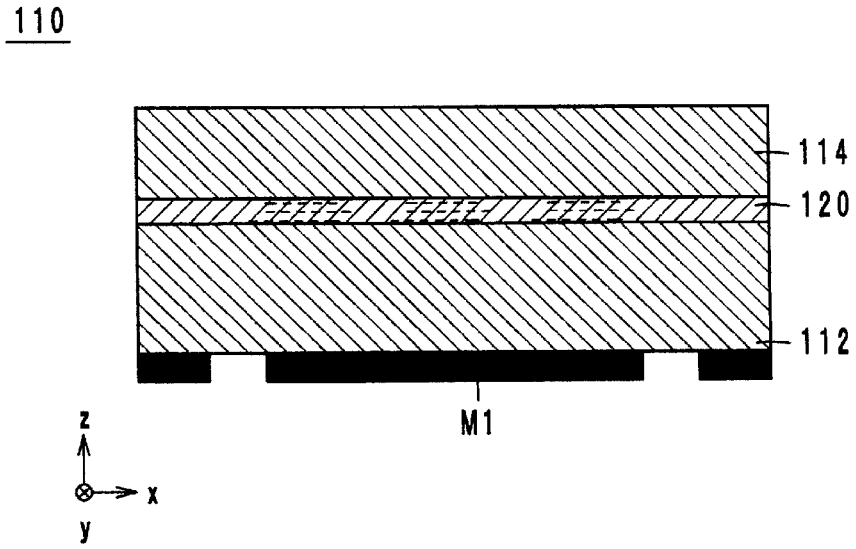
FIG. 5 is a cross-sectional view illustrating the composite electronic component that is being manufactured.

Then, the lower surface of the mother substrate 112 is grinded and polished, and the resist is applied onto the lower surface. Thereafter, a resist pattern M1 as illustrated in FIG. 5 is formed by the photolithography such that portions of the resist, which correspond to the cutouts on the corners E1 to E4 of the composite electronic component 1, are formed as gaps.

Figure 6:
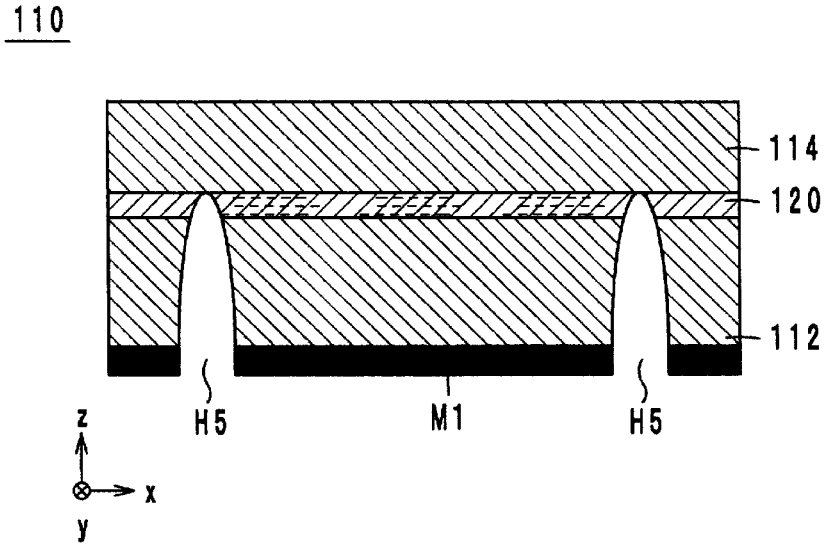
FIG. 6 is a cross-sectional view illustrating the composite electronic component that is being manufactured.
Figure 7:
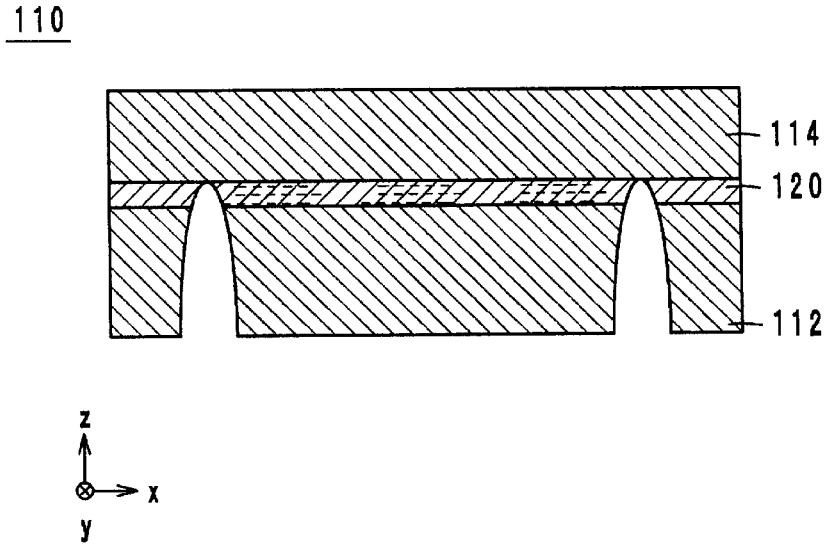
FIG. 7 is a cross-sectional view illustrating the composite electronic component that is being manufactured.

In addition, sandblasting is performed by using the resist pattern M1 as a mask. With this, as illustrated in FIG. 6, holes H5 corresponding to the corners E1 to E4 are formed on the mother main body 110. Then, as illustrated in FIG. 7, the resist pattern M1 is removed by an organic solvent. In this process, laser processing may be used instead of the sandblasting. Alternatively, the sandblasting and the laser processing may be combined.

Figure 8:
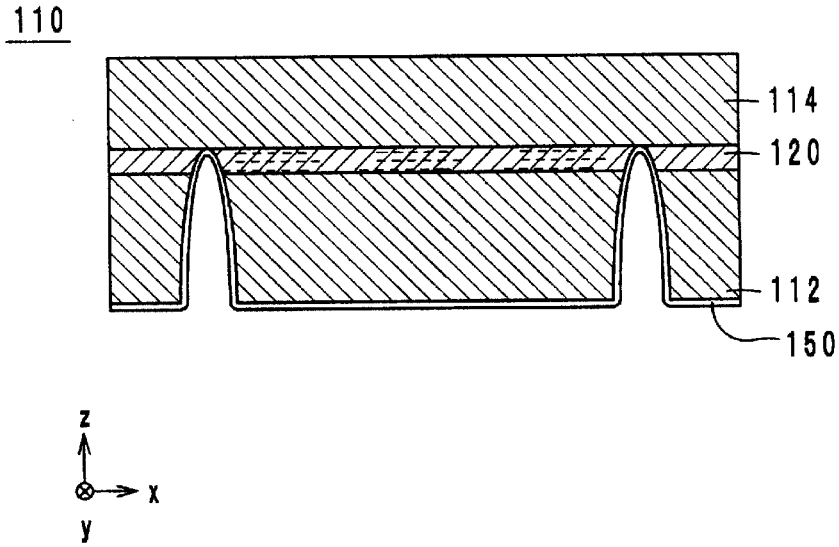
FIG. 8 is a cross-sectional view illustrating the composite electronic component that is being manufactured.

Subsequently, as illustrated in FIG. 8, a Ti/Cu thin film 150 obtained by forming a Cu thin film on a Ti thin film is formed on the lower surface of the mother substrate 112 subjected to the sandblasting by the sputtering method.

Figure 9:
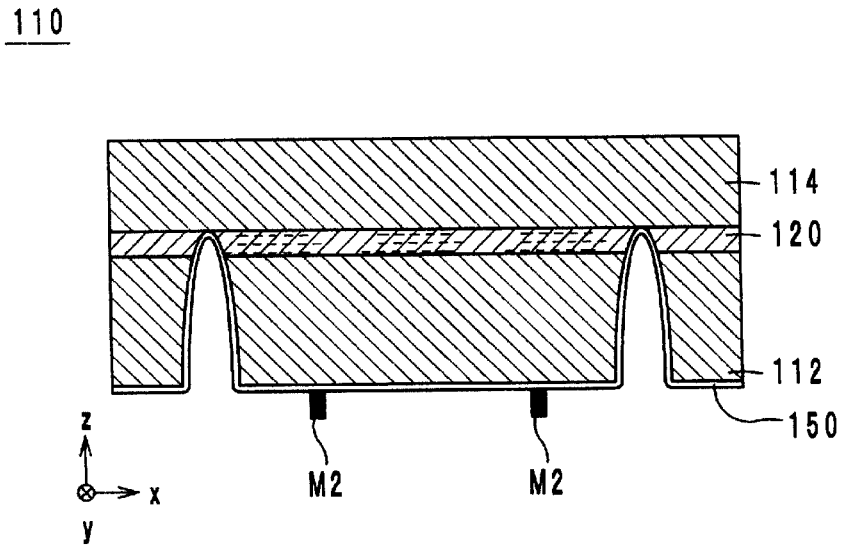
FIG. 9 is a cross-sectional view illustrating the composite electronic component that is being manufactured.

Then, a resist is applied onto the Ti/Cu thin film 150. In addition, a resist pattern M2 as illustrated in FIG. 9 is formed by the photolithography such that portions of the resist, which correspond to the terminal portions 41*a* to 44*a* of the outer electrodes 41 to 44, the ground electrodes 61 and 62, the connection electrode 63, and the discharge electrodes 64 and 65 of the antistatic element 60, are formed as gaps.

Figure 10:
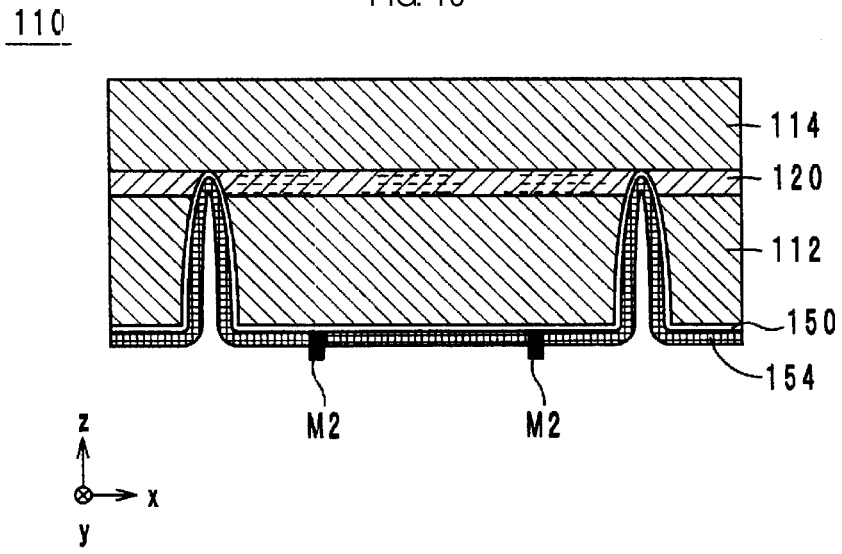
FIG. 10 is a cross-sectional view illustrating the composite electronic component that is being manufactured.

As illustrated in FIG. 10, a copper-plated film 154 is formed by an electrolytic plating process using the Ti/Cu thin film 150 as a feeding film. With this, copper plating is carried out on the Ti/Cu thin film 150 that is not covered by the resist pattern M2. Thereafter, the resist pattern M2 is removed by an organic solvent, so that the terminal portions 41*a* to 44*a*, the ground electrodes 61 and 62, the connection electrode 63, and the discharge electrodes 64 and 65 are formed on the lower surface of the mother substrate 112.

Further, the excess feeding film is etched using the terminal portions 41*a* to 44*a*, the ground electrodes 61 and 62, the connection electrode 63, and the discharge electrodes 64 and 65 as masks. The etching is made by only the thickness of the Ti/Cu thin film 150, so that the copper-plated film 154 corresponding to the terminal portions 41*a* to 44*a*, the ground electrodes 61 and 62, the connection electrode 63, and the discharge electrodes 64 and 65 remains on the lower surface of the mother substrate 112.

Figure 11:
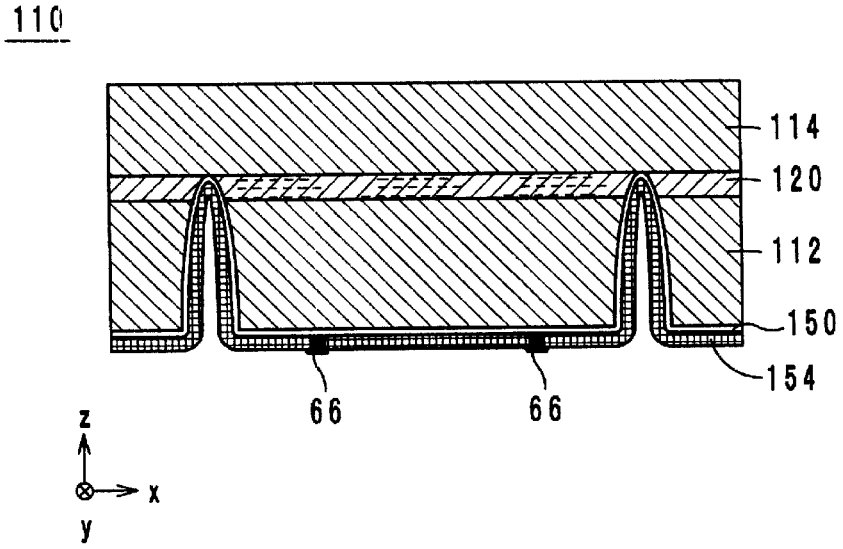
FIG. 11 is a cross-sectional view illustrating the composite electronic component that is being manufactured.

Further, a synthetic resin or the like containing conductive fine powder, which has been made into a liquid form with a solvent, is made to drop or printed onto the gaps A1 to A4 on the discharge electrodes 64 and 65 formed on the lower surface of the mother substrate 112 by a dispenser or screen printing. The obtained synthetic resin is dried to form the static electricity absorbers 66 as illustrated in FIG. 11. With this, the antistatic element 60 is formed on the lower surface S0 of the mother substrate 112.

Figure 12:
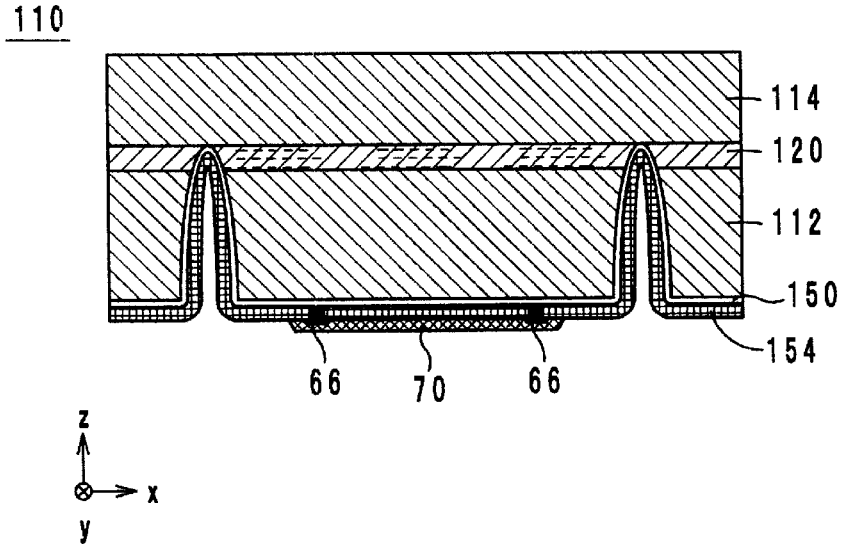
FIG. 12 is a cross-sectional view illustrating the composite electronic component that is being manufactured.

After the antistatic element 60 has been formed, a film made of epoxy or the like is formed on the lower surface S0 of the mother substrate 112 by screen printing or the like. With this, the antistatic element protection layer 70 as illustrated in FIG. 12 is formed.

Figure 13:
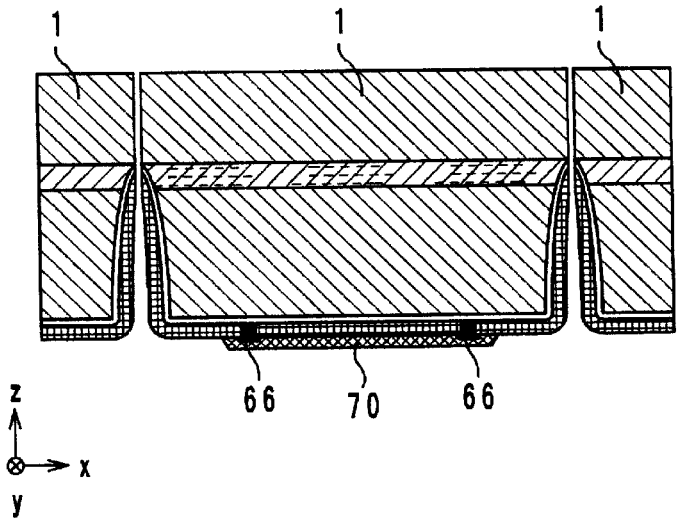
FIG. 13 is a cross-sectional view illustrating the composite electronic component that is being manufactured.

Finally, as illustrated in FIG. 13, the mother main body 110 is cut. In this case, cut lines for the cutting are set to lines passing through the centers of the holes H5 corresponding to the corners E1 to E4 formed on the mother substrate 112. This provides a plurality of composite electronic components 1.

Chamfering processing may be performed on the completed composite electronic component 1 by barrel processing or the like. In addition, Sn plating and Ni plating may be performed on the outer electrodes 41 to 44.

Effects

In the composite electronic component 1, the ground electrodes 61 and 62 included in the antistatic element 60 are provided on only the lower surface S0 of the magnetic substrate 12. Accordingly, the surfaces of the insulator layers 21 and 22 on which the coils 31 and 32 are provided, respectively, do not intersect with the ground electrodes 61 and 62. This prevents the coils 31 and 32 and the ground electrodes 61 and 62 from coming close to each other, thereby suppressing generation of stray capacitance.

Further, the lower surface S0 of the magnetic substrate 12 is the mounting surface, so that the outer electrodes 41 to 44 are located thereon. Accordingly, the respective electrodes of the antistatic element 60 and the outer electrodes 41 to 44 can be formed at the same time in the manufacturing process of the composite electronic component 1. That is to say, the manufacturing process of the composite electronic component 1 can be simplified.

Further, the magnetic substrate 12 corresponds to a substrate formed in the lamination process of the composite electronic component 1, that is, a portion located at the lowermost layer, so that irregularities made by the lamination processing are small on the magnetic substrate 12. Accordingly, in the composite electronic component 1, distances of the gaps A1 to A4 on the discharge electrodes 64 and 65 can be controlled easily in comparison with the case where the antistatic element 60 is provided on the upper surface of the magnetic layer 14.

In addition, in the composite electronic component 1, the antistatic element 60 is provided on the lower surface S0 of the magnetic substrate 12, that is, at the negative side in the z-axis direction whereas the coils 31 and 32 are provided on the magnetic substrate 12 at the positive side in the z-axis direction. With this, in the composite electronic component 1, the antistatic element 60 is not interposed between the coils 31 and 32 and the magnetic substrate 12. This suppresses shielding of the magnetic fluxes that are generated on the coils 31 and 32 and travel toward the magnetic substrate 12 by the antistatic element 60. Accordingly, the composite electronic component 1 can provide a larger common mode impedance than that when the antistatic element 60 is provided on the upper surface of the magnetic substrate 12.

Moreover, in the composite electronic component 1, sufficient distances between the antistatic element 60 and the coils 31 and 32 can be kept when the magnetic substrate 12 having the thickness that is much larger than those of the insulator layers is used. This enables the composite electronic component 1 to suppress stray capacitance that is generated between the respective electrodes of the antistatic element 60 and the coils 31 and 32.

The sufficient distances between the antistatic element 60 and the coils 31 and 32 can be kept, thereby reducing the necessity that the coils 31 and 32 and the ground electrodes 61 and 62 are arranged so as not to overlap with each other when seen from the z-axis direction in the composite electronic component 1. Accordingly, the degree of freedom in the layout of the coils 31 and 32 is high in the composite electronic component 1.

If the antistatic element 60 is provided on the upper surface of the magnetic substrate 12, when the distances between the coils 31 and 32 and the antistatic element 60 are tried to be made larger, a distance between the magnetic substrate 12 and the magnetic layer 14 is increased. In this case, the common mode impedance of the composite electronic component 1 is lowered. Unlike this configuration, the composite electronic component 1 has a configuration in which the antistatic element 60 is provided on the lower surface of the magnetic substrate 12, so that the increase in the distance between the magnetic substrate 12 and the magnetic layer 14 can be suppressed. Thus, in the composite electronic component 1, lowering of the common mode impedance can be suppressed, as a result.

Other Embodiments

The composite electronic component and the composite electronic component manufacturing method according to the disclosure are not limited to the above-mentioned embodiment and can be variously changed within the range of the scope thereof. For example, the shapes and the sizes of the cutouts provided on the corners E1 to E4 of the magnetic substrate 12 are arbitrary.

As described above, the disclosure is effective for the composite electronic component including the antistatic element and the coil and the method of manufacturing the same. The disclosure is excellent in a point of suppressing stray capacitance that is generated between the ground electrode included in the antistatic element and the coil.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A composite electronic component comprising:

a multilayer body formed by laminating a plurality of insulator layers, a first coil provided on one of the insulator layers, an antistatic element connected to the first coil and including a ground electrode, an outer electrode connected to the first coil, and a static electricity absorber disposed between the antistatic element and the outer electrode, wherein at least a portion of the ground electrode is coplanar with the static electricity absorber and at least a portion of the outer electrode, and wherein the ground electrode does not intersect with a surface of the one insulator layer on which the first coil is provided.

2. The composite electronic component according to claim 1, further comprising a magnetic substrate, wherein the ground electrode is provided only on an electrode formation surface of the magnetic substrate located at a side opposite to the first coil with respect to the magnetic substrate.

3. The composite electronic component according to claim 2, wherein the electrode formation surface is a mounting surface.

4. The composite electronic component according to claim 2, further comprising:

a second coil; and a magnetic layer located at a side opposite to the magnetic substrate with respect to the multilayer body, wherein the first coil and the second coil are electromagnetically coupled to each other so as to function as a common mode choke coil.

5. The composite electronic component according to claim 4, wherein a thickness of the magnetic substrate is larger than a thickness of the magnetic layer.

6. The composite electronic component according to claim 4, wherein an initial magnetic permeability of the magnetic substrate is higher than an initial magnetic permeability of the magnetic layer.

7. The composite electronic component according to claim 4, wherein the magnetic substrate is a sintered body, and the magnetic layer is formed of a resin containing magnetic powder.

8. A method of manufacturing the composite electronic component according to claim 1, comprising:

forming the outer electrode and a conductor included in the antistatic element at the same time.

* * * * *